US006237677B1

(12) United States Patent
Kent et al.

(10) Patent No.: US 6,237,677 B1
(45) Date of Patent: May 29, 2001

(54) EFFICIENCY CONDENSER

(75) Inventors: Scott Edward Kent, Albion; David A. Southwick, Lockport; Mohinder Singh Bhatti, Amherst, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/384,100

(22) Filed: Aug. 27, 1999

(51) Int. Cl.[7] ..... F28B 1/06; F28F 9/22
(52) U.S. Cl. ..... 165/110; 165/174
(58) Field of Search ..... 165/174, 110

(56) References Cited

U.S. PATENT DOCUMENTS

| | | | | |
|---|---|---|---|---|
| 3,719,854 | | 3/1973 | Staub . | |
| 4,141,409 | * | 2/1979 | Woodhull, Jr. et al. | 165/174 X |
| 4,972,683 | * | 11/1990 | Beatenbough | 165/174 X |
| 5,186,249 | * | 2/1993 | Bhatti et al. | 165/174 |
| 5,752,566 | | 5/1998 | Liu et al. . | |
| 6,062,303 | * | 5/2000 | Ahn et al. | 165/174 X |

FOREIGN PATENT DOCUMENTS

| | | |
|---|---|---|
| 887611 | 12/1998 | (EP) . |
| 2596858 | 10/1987 | (FR) . |
| 2665757 | 2/1992 | (FR) . |
| 3-140764 | 6/1991 | (JP) . |

* cited by examiner

*Primary Examiner*—Leonard Leo
(74) *Attorney, Agent, or Firm*—Patrick M. Griffin

(57) ABSTRACT

An air conditioning system refrigerant condenser (24) has opposed, parallel, vertical header tanks header tanks (12', 14') with a substantially uniform internal cross sectional area. The inlet tank (12') and return tank (14') are connected by a plurality of generally parallel flow tubes (16'), each of which is identical in size and shape with unrestricted ends opening into each header tank (12', 14'). The refrigerant inlet (20') into the inlet tank (12') is located relatively high up, as is the outlet (22') on the other tank, creating both a vapor deficit in the lower flow tubes (16') that are farthest from the inlet (20'), as well as liquid pooling in the lower flow tubes (16') that are below the outlet (22'). By placing a simple flow restriction (26) in the return tank (14') that restricts the flow, through the return tank (14'), of the refrigerant flowing from the higher, surplus flow tubes (16') and to the refrigerant outlet (22'), a back pressure is created in the return tank (14') that indirectly shifts fluid flow within the inlet tank (12'), away from the surplus flow tubes and toward the deficit flow tubes. This rebalances the refrigerant flow through all flow tubes (16') to improve overall condenser efficiency.

2 Claims, 4 Drawing Sheets

EFFICIENCY CONDENSER

TECHNICAL FIELD

This invention relates to air conditioning systems in general and specifically to an improved efficiency condenser.

BACKGROUND OF THE INVENTION

An early, common type of automotive air conditioning condenser was the so called serpentine condenser, in which one refrigerant flow tube (or sometimes one tube pair) tube was continually folded back and forth on itself in a meandering pattern. All refrigerant flowed through the single tube or tube pair, back and forth, from one end to the other. Despite an inherent efficiency limitation of a high refrigerant pressure drop resulting from the long flow path, the design was simple and robust. Only two potential leak paths, at the two ends of the single tube, had to be sealed, and very few parts were involved in its manufacture.

Since at least the early 1980's, there had been a natural progression in the automotive industry away from serpentine, single tube condensers to multi flow tube condensers, most accurately referred to as headered or cross flow condensers. Headered condensers include a pair of opposed, parallel, elongated manifolds or header tanks, which distribute refrigerant into and out of a plurality of much shorter flow tubes, each about as long as one bend in an equivalent serpentine design. The header tanks, in turn, have a single discrete refrigerant inlet and outlet that feed and drain them of refrigerant. The header tanks are generally vertical (so that the flow tubes are horizontal), although that pattern may be reversed in a so-called down flow design. Since each single flow tube is much shorter than the single tube of equivalent capacity serpentine design, the pressure drop across each individual tube is far less. The smaller potential pressure drop, in turn, allows smaller flow passages within each flow tube, which inherently increases heat transfer efficiency. The main drawback of the headered design is that each of the two ends of each shorter flow tube must be sealed where they enter the header tanks, which greatly multiplies the potential leak points. Improvements in the brazing process widely available in the late 70's and early 80's have essentially obviated that concern, however, and accelerated the shift toward the headered design.

One inherent drawback of the headered condenser design, however, is the inability of the header tanks to feed refrigerant into and out of the individual flow tubes evenly. This is exacerbated when the tanks are long and the number of flow tubes large, inevitably putting the ends of many of the tubes far distant from the single, discrete header tank inlet and/or outlet, especially the inlet. The problem is even worse when the inlet is near the upper end of a vertical tank, as it often is. Tubes closer to the discrete inlet will have a surplus refrigerant flow, those more distant a flow deficit. This is a problem that has been long recognized, but the proposed solutions to date have been impractical from a manufacturing standpoint.

One potential solution would be to create an inlet header tank which, rather than having a uniform cross sectional area along its length, is larger at points more distant from the inlet, so as to feed more refrigerant to the tubes that would otherwise be starved of flow. However, condenser tubes are most often made of an aluminum extrusion, which has to have a uniform cross section along its length. The obvious equivalent of a varying cross section tank would, instead, be flow tubes with a varying flow passage size, those more distant from the inlet being larger and vice versa. An equivalent to varying flow passage size tubes would be the use of tube end blocking structures that effectively blocked part of the otherwise fully open ends of those flow tubes nearer the inlet, leaving the more distant tubes more open or fully open. Making and accounting for different thickness flow tubes would be impractical and expensive, as would adding individual tube end blocking structures, however, and the extra cost would not be worth the efficiency gain.

An early reference that extolled the benefits of shifting from a serpentine to a headered condenser design also recognized the inherent problem of refrigerant flow imbalance. Laid Open Japanese Utility Model 57-66389, published in 1982, proposed a couple of solutions, one of which is impractical in some cases, and the other of which is impractical in all cases. The sometimes practical approach is the well known process of "multipassing" the flow. Baffles or separators, which are internal dams that completely block flow at selected points along the length of the header tanks, cause the flow to run back and forth in a large scale imitation of serpentine flow. One baffle yields two passes, two yield three, and so on, although it would be rare to provide more than three passes. Since each flow pass has fewer than all tubes in it, fewer tubes are as distant from the inlet or outlet, and the flow is more even through those passes. The pressure drop is greater than for a single pass design with no baffles, but efficiency can be increased in many cases, and a sufficient increase in efficiency is worth a tolerable pressure drop increase. The totally impractical approach proposed is to feed a fraction of the total refrigerant flow directly into each flow tube separately with dedicated, capillary pipes, one for each end of each flow tube. These individual tube feeders radiate out like tines of a fork from a central distributor, and occupy a great deal of space on the sides of the core. With anything more than a handful of flow tubes, such an approach would be impossible from a manufacturing and packaging standpoint.

Even the theoretically practical approach of multi passing is unusable in many cases, again because of packaging concerns. Often, the lines to the refrigerant inlet and outlet must be located on opposite sides of the condenser. This is fine for a single pass condenser, since the inlet and the outlet (on opposite tanks) are already on opposite sides of the condenser. But a two-pass design, with its U shaped flow pattern, puts the inlet and outlet on the same header tank and same side of the core. A long cross over pipe would be necessary to connect the outlet back to the opposite side of the condenser. A three pass design, with a "Z" shaped flow pattern, would put the inlet and outlet back on opposite sides, but the pressure drop will often be too great with three passes, and the outlet will be forced to the bottom lower corner, which may be an inconvenient location for it.

Therefore, a single pass condenser design is often the only practical design for many vehicle architectures. When a large plurality of flow tubes is used with a single pass design and vertical header tanks, yet another problem can present itself, in addition to the inevitable flow imbalance described above. Often, the inlet or outlet or both will be located high up on the vertical tanks, again, because of vehicle architecture and packaging constraints. This creates the potential for liquid refrigerant to pool in the lower flow tubes, which are the tubes most distant from the inlet and outlet, under the force of gravity. The pooled liquid refrigerant further blocks refrigerant vapor flow through the very flow tubes, the lower tubes, that already have a deficit of refrigerant vapor flow, and forces it up and through the upper tubes that have a surplus of flow. The effective working area of the condenser is greatly reduced. This liquid pooling/gas blockage problem is not an issue with heat exchangers that comprise all liquid flow, like radiators and heater cores, so radiator and heater core design features related to fluid flow are not useful per se in solving the pooling problem.

SUMMARY OF THE INVENTION

The features specified in Claim 1 characterize an improved efficiency condenser in accordance with the present invention.

The invention provides a simple and practical mechanism to shift and rebalance flow in any condenser in which the location of inlet or outlet relative to the flow tubes would otherwise create a flow surplus in some tubes and a deficit in others. The preferred embodiment disclosed comprises a single pass condenser with vertical tanks and with the refrigerant inlet located very high up on the inlet header tank on one side, and the refrigerant outlet located relatively high up on the return header tank on the opposite side. This configuration presents the most difficult aspects of the flow imbalance problem, as described above, with a vapor flow surplus in the upper tubes nearer the inlet, and a flow deficit in the lower tubes located both far from the inlet, especially below the outlet, where liquid pooling occurs.

The refrigerant flow is shifted and rebalanced without changing the uniform cross sectional area of the header tanks and without changing the flow passage size of the flow tubes or blocking or directly restricting their individual end openings. Instead, a flow restriction is placed at a location within the return header tank that partially blocks off the cross sectional area of the tank, and thereby restricts flow within the tank itself, but does not directly block flow out of the ends of the individual flow tubes into the tank. This creates a back pressure above the restriction, which indirectly causes refrigerant flow within the inlet header tank to shift down and away from the upper tubes to the lower tubes. This shifted flow acts to push pooled liquid out of the lower tubes, as well as better balancing flow throughout the whole condenser, improving its overall efficiency.

BRIEF DESCRIPTION OF THE DRAWINGS

These and other features of the invention will appear from the following written description, and from the drawings, in which.

DESCRIPTION OF THE PREFERRED EMBODIMENT

Figure 1:
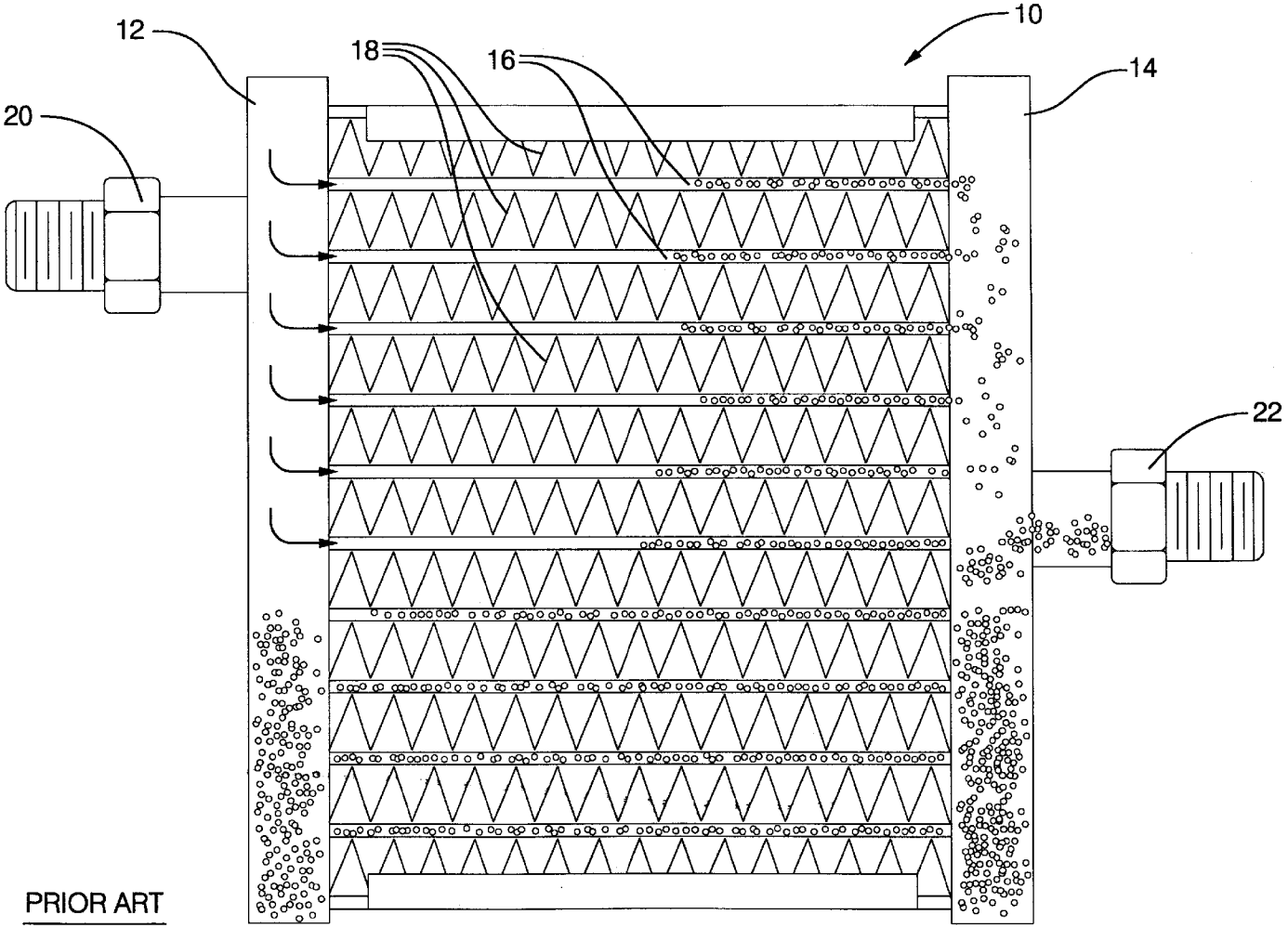
PRIOR ART FIG. 1
FIG. 1 is a view of a conventional single pass condenser without the enhancement of the invention, illustrating the pooled liquid that occurs in the lower tubes and the bias of vapor flow through the upper tubes.

Referring first to FIG. 1, a typical single pass condenser, indicated generally at 10, is, in general, a rectangular, brazed aluminum construction, in which every part, to the maximum extent possible, is regular in size, evenly spaced, and interchangeable. This is necessary for low cost manufacture, and that regularity is essentially unchanged in the subject invention, which is a great benefit. Condenser 10 has a pair of parallel, opposed, elongated header tanks, an inlet header tank 12 and return header tank 14. Such tanks are often two piece designs, made up of an extruded main tank piece brazed to a slotted header piece, which would be the easiest construction in which to incorporate the enhancement of the invention. But, in newer designs, the tanks may be one piece, either an extruded, integral cylindrical tank or fabricated cylindrical tank. Either way, the tanks 12 and 14 preferably have a uniform, constant internal cross sectional area all along their length. The tanks 12 and 14, as shown, are vertical or nearly vertical, which is the most common orientation, although they could be horizontal. Each tank 12 and 14 is slotted to receive one of the opposed ends of a regularly spaced series of identical, flattened aluminum flow tubes, each of which is indicated at 16. Only a few flow tubes 16 are illustrated for purposes of simple illustration, but in actual production condensers, thirty or more closely spaced tubes like 16 may be used. The end of each tube 16 opens into its respective tank 12 or 14 through a close fitting slot, which is brazed or otherwise sealed leak tight. Conventional corrugated air fins 18 are brazed between each adjacent pair of flattened flow tubes 16. A refrigerant inlet 20 is fixed to inlet header tank 12 very near the upper end. A refrigerant outlet 22 is fixed to return header tank 14 near the center. The locations of inlet 20 and outlet 22 are dictated more by packaging concerns than concerns of efficient refrigerant flow.

Still referring to FIG. 1, the resultant refrigerant flow in condenser 10 is illustrated. Pressurized, hot refrigerant vapor enters inlet 20 and inlet header tank 12 from a non illustrated compressor. From there, vapor is distributed to the open ends of the flow tubes 16, flowing across and out into the return tank 14 and finally out of the outlet 22 and on to a non illustrated expansion valve and evaporator. As it flows across the tubes 16, the hot, compressed vapor is cooled by a fan driven air stream passing over the tubes 16 and fins 18 and ultimately liquefied (condensed). Ideally, a roughly equal proportion of vapor would be fed from the inlet header tank 12 and into the ends of the flow tubes 16, so that a roughly equal degree of condensing would occur in each tube. However, the two effects described above prevent that ideal, regular and even flow. First, the ends of the uppermost tubes 16 are simply closer to the refrigerant inlet 20, and refrigerant vapor will naturally more easily reach and flow through those tubes due to proximity alone, as indicated by he arrows. Conversely, it will be less inclined to reach the lower tubes, creating a deficit there. Second, with vertical tanks 12 and 14, condensed, liquefied refrigerant will tend to pool under the force of gravity in those same lowermost tubes, a problem magnified by the relatively high location of the outlet 22, which drains the return tank 14. The pooled liquid, in turn, blocks and resists the already diminished vapor flow through the lower tubes, increasing the flow deficit. In effect, a much diminished area of the total condenser area is working efficiently to continually receive and condense vapor flow. Stated differently, the condenser 10 must be made larger than it would otherwise have to be if it worked more efficiently.

Figure 2:
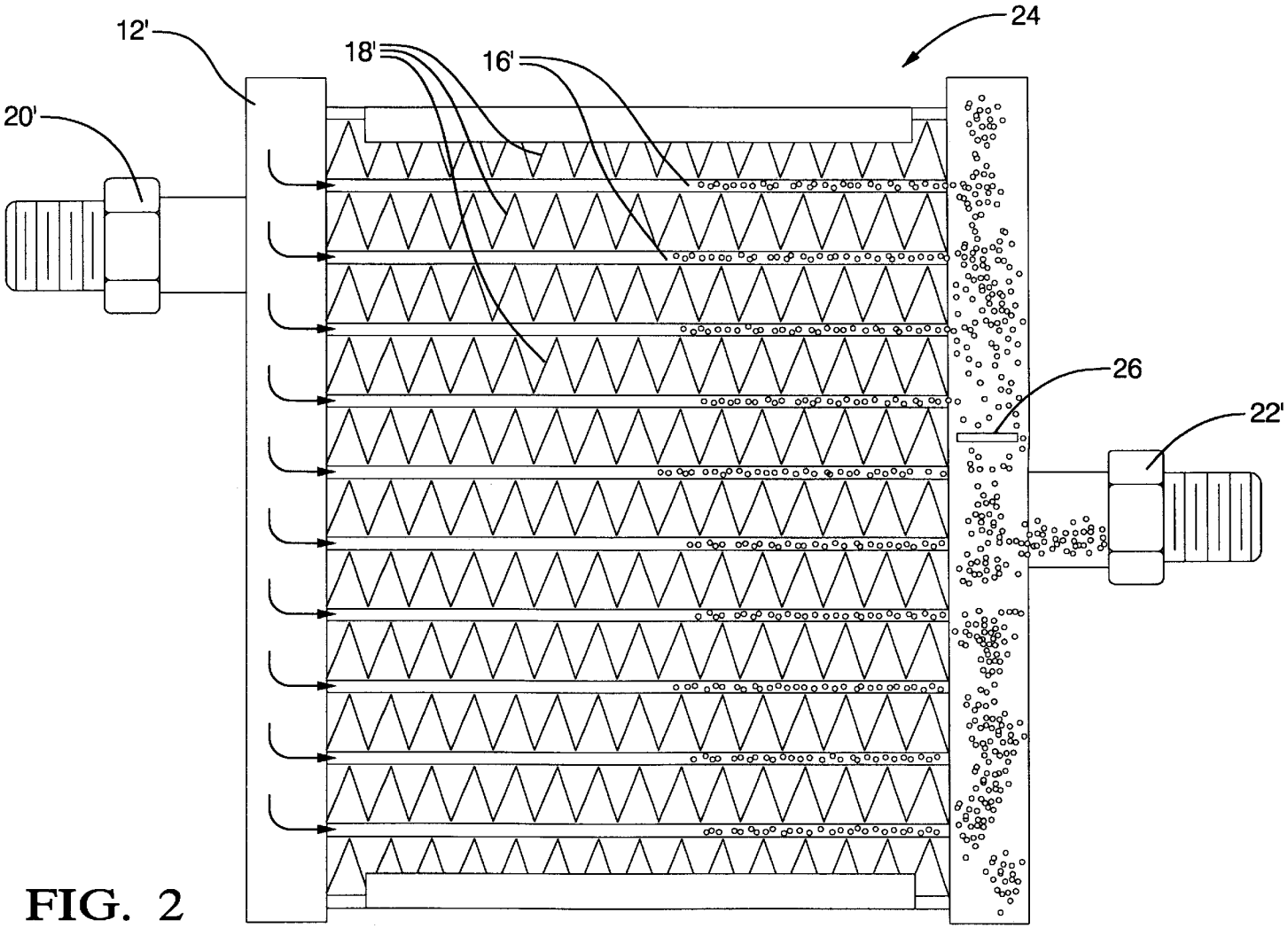
FIG. 2 is a view of a same size single pass condenser, altered only by the addition of the flow restriction of the invention, and showing the consequently rebalanced flow throughout.
Figure 3:
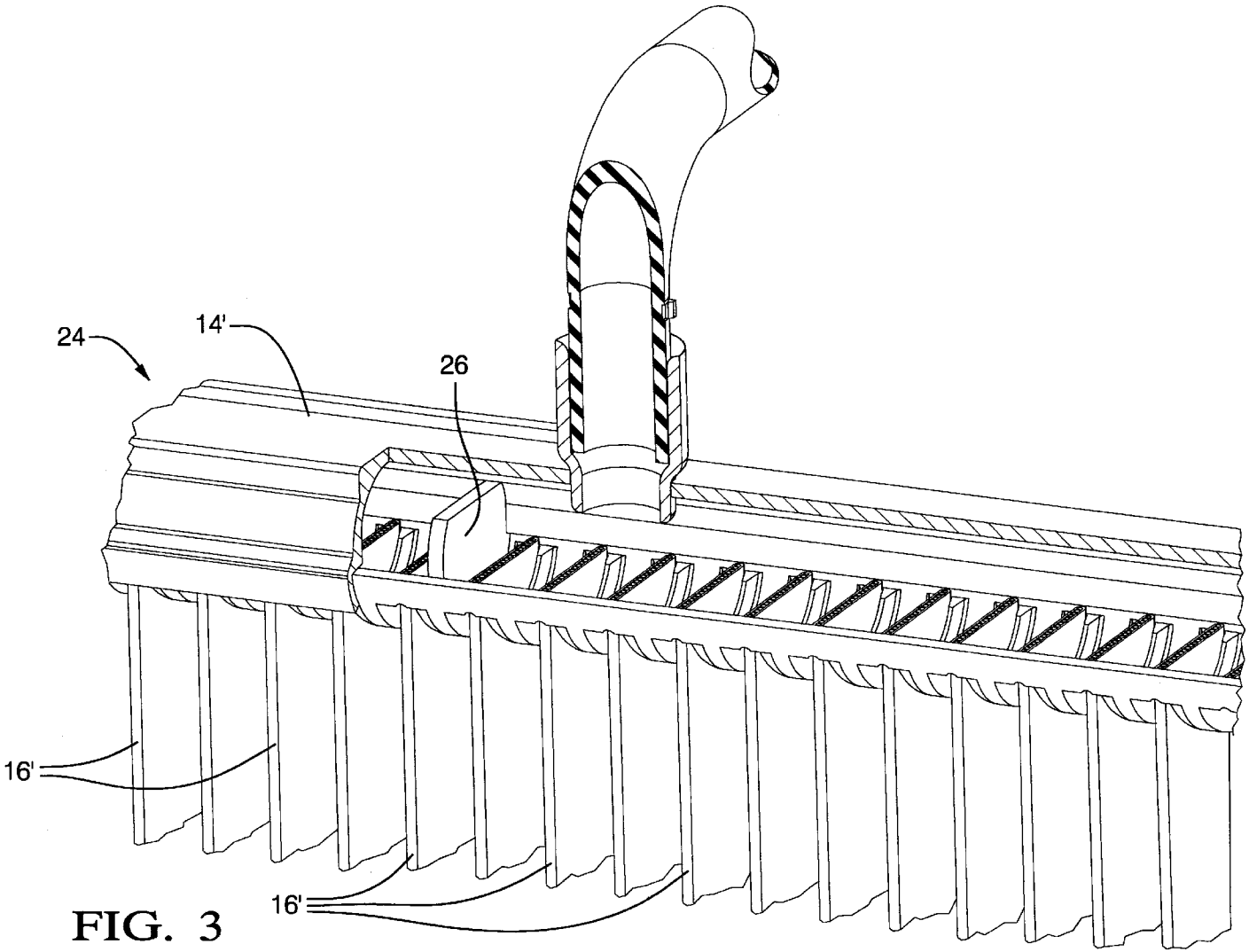
FIG. 3 is a perspective view of the return tank broken away to show details of the flow restriction.

Referring next to FIGS. 2 and 3, an improved condenser according to the invention is indicated generally at 24. Condenser 24 is identical, in materials and basic components and dimensions, to condenser 10, and equivalent components are given the same number with a prime (') to so indicate. More specifically, the dimensions and number of the flow tubes 16' are not changed, and the internal cross sectional area and shape of the header tanks 12' and 14' are not changed. Therefore, the basic manufacture and construction of condenser 24 can be identical to condenser 10. The only structural change is the addition, inside of return header tank 14', of a flow restriction in the form of a thin, flat, truncated aluminum disk 26, located just above the outlet 22', and best seen in FIG. 3. The perimeter of disk 26 matches the shape of the inner cross section of return tank 14', but for a chordal section that is removed to create a reduced or restricted flow area. Disk 26 can be easily installed, as by stamping a shallow pocket or groove into the inner surface of return tank 14' to receive the edge of disk 26. In the embodiment disclosed, the restriction created is quite high, and the ratio of the reduced flow area to the original cross section is approximately 0.12, although that exact ratio is not necessary, as is described farther below.

Referring again to FIG. 2, the operation of condenser 24 is described. Pressurized, hot refrigerant vapor enters inlet header tank 12', and initially has the same tendency to favor flow through the uppermost tubes 16' as with condenser 10. However, vapor exiting the opposite ends of the upper tubes 16', that is, exiting those tubes above the disk 26, does not have a free, unrestricted flow path within the return tank. The flow out of the return tank ends of the flow tubes 16' is not directly or individually restricted per se, either by necking them down or otherwise blocking them with individual structures, which would be very impractical from a manufacturing standpoint. Instead, the otherwise unimpeded flow out of the far ends of the flow tubes 16' and into the return tank 14' is thereafter restricted in it's flow down through the inside of return tank 14' to outlet 22'. Flow moving down through return tank 14' encounters the rather severe, almost 90% restriction presented by the disk 26, and a back pressure is created above disk 26, within the interior of return tank 14'. This back pressure retards flow through the upper tubes 16' on a mass, rather than an individual basis, and causes vapor flow to shift downwardly within the inlet tank 12' and into the lower tubes 16', that is, those generally below the level of the disk 26. The net result, as illustrated, is that vapor flow is more evenly divided among all tubes, as illustrated, with vapor entering one end of each flow tube 16' from the inlet tank 12', flowing across and leaving the other end into the return tank 14' as condensed liquid, in a regular and consistent pattern. This also acts to keep liquid refrigerant continually blown or swept out of the lower tubes 16', preventing the liquid pooling illustrated above. All of the potential of condenser 24 is effectively used, meaning that it can have a higher capacity than condenser 10, or simply be made smaller for the same capacity.

Figure 4:
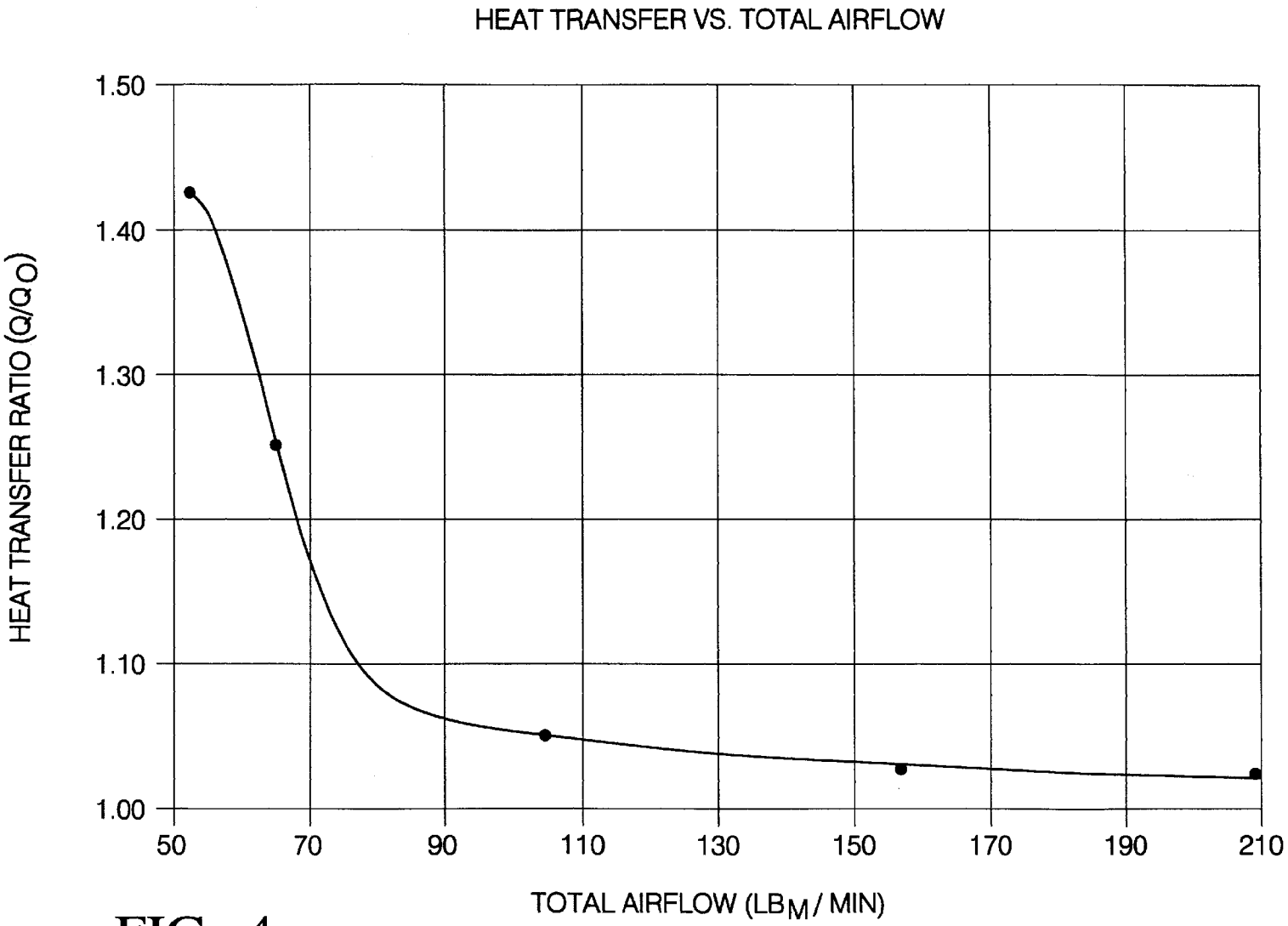
FIG. 4 is a graph showing the ratio of the heat transfer for condensers with and without the enhancement of the invention versus the flow rate of cooling air flow over the condenser, for an optimal flow restriction size of the invention.

Referring next to FIG. 4, the quantitative results of the operation of condenser 24 are presented graphically. The Y axis shows the ratio of the heat transfer of condenser 24 ("Q") to a base line, non enhanced condenser ("$Q_O$"), of equivalent size, like condenser 10 described above. The X axis shows various air flow rates, with the lower air flow rates corresponding to idling, and the higher rates corresponding to higher vehicle speeds. At the quite restrictive area reduction of 0.12 described above, the enhancement of heat transfer is surprisingly high at lower air flow rates, with a ratio higher than 1.4. Achieving a 40% increase in heat transfer rate with so little structural change to the condenser was very unexpected. On the other hand, one would also expect to pay a heavy price on the other end, that is, at higher vehicle speeds, because of increased refrigerant side pressure drop caused by the severe restriction. In fact, however, the ratio only approaches 1, and never drops below 1, so there is no quantitative disadvantage at any speed.

Other experimentation has shown that the restriction ratio referred to above, while optimal at approximately 0.12, can range over approximately 0.05 to 0.25 and still yield a noticeable improvement in heat transfer. The particular embodiment of the flow restriction disclosed, disk 26, is very simple to manufacture and install, especially in a header tank of the two piece type, although it could also be inserted, in ram rod fashion, into a single piece header tank. It is particularly advantageous considering that it is a single, discrete, structure, not associated with or directly blocking any particular flow tube 16', and yet acting in to affect flow through many flow tubes 16' at once, albeit in an indirect fashion. Flow restrictions of other design could be used, potentially even active devices such as an iris that changes its degree of restriction in response to other measured parameters, such as heat exchanger or air temperature, or vehicle or compressor speed. The invention is particularly useful in regard to the single pass condenser design disclosed, with its requirement that inlet and outlet fittings be located on opposite sides of the core. However, even multi pass condenser designs with a large total number of tubes could have enough tubes in the first or inlet pass so that those flow tubes farthest from the inlet suffered from the same flow starvation problem. In that case, a similar flow restriction in the return tank could provide a similar benefit. For example, in a simple two pass design, the outlet is on the first tank, not the opposed return tank, and both the inlet and outlet are fixed to the first tank. The outlet is located below (and the inlet located above) a flow separating baffle in the first tank that divides the first pass tubes (which empty into the return tank) from the second pass tubes (which empty into the outlet). A similar flow restriction in the return tank which impeded the otherwise direct flow through the return tank from those first pass tubes that had a flow surplus would create the same kind of back pressure in the return tank that would indirectly shift refrigerant flow within the first pass portion (inlet portion) of the first tank and to those tubes that would otherwise suffer a flow deficit. Still, it is contemplated that the most frequent and advantageous application of the invention would be for one pass designs, especially those that have vertical tanks, a high mounted outlet on the return tank, and the liquid refrigerant pooling problem described above.

What is claimed is:

1. An air conditioning system refrigerant condenser (24) having opposed, substantially parallel, vertically oriented, elongated header tanks (12', 14') of substantially uniform internal cross sectional area, including an inlet tank (12') and a return tank (14'), with a plurality of generally parallel flow tubes (16') extending between the inlet tank (12') and return tank (14'), generally perpendicular thereto, said flow tubes (16') having substantially equal sized ends opening unrestricted into each header tank (12', 14'), said condenser (24) also having a refrigerant inlet (20') into the inlet tank (12') and a refrigerant outlet (22') out of the return header tanks (14'), so that a refrigerant vapor flows through the inlet (20') into the inlet tank (12'), across the flow tubes (16') into the return header tank (14') and then out of the outlet (22') and in which at least the refrigerant inlet (20') is sufficiently distant from a number of flow tubes (16') so as to create a refrigerant flow surplus in the flow tubes (16') nearer the refrigerant inlet (20') and a refrigerant flow deficit (22') through the flow tubes (16') farther from the inlet (20'), characterized by;

a flow restriction (26) located in the return tank (14') that restricts the flow, through the return tank (14'), of refrigerant flowing from the surplus flow tubes (16') to the refrigerant outlet (22'), so as to create a back pressure in said return tank (14') that indirectly shifts fluid flow within the inlet tank (12'), away from the surplus flow tubes and toward the deficit flow tubes, thereby better balancing the refrigerant flow through all flow tubes (16') to improve overall condenser efficiency.

2. An air conditioning system according to claim 1, further characterized in that said outlet (22') is located above the bottom of header tank (14').

* * * * *